US007116295B2

(12) United States Patent
Shih

(10) Patent No.: US 7,116,295 B2
(45) Date of Patent: Oct. 3, 2006

(54) METHOD AND SYSTEM FOR TESTING DRIVER CIRCUITS OF AMOLED

(75) Inventor: An Shih, Changhua (TW)

(73) Assignee: TPO Displays Corp., Miao-Li (TW)

( * ) Notice: Subject to any disclaimer, the term of this patent is extended or adjusted under 35 U.S.C. 154(b) by 362 days.

(21) Appl. No.: 10/460,196

(22) Filed: Jun. 13, 2003

(65) Prior Publication Data

US 2004/0189559 A1 Sep. 30, 2004

(30) Foreign Application Priority Data

Mar. 31, 2003 (TW) ..... 92107304 A

(51) Int. Cl.
*G09G 3/34* (2006.01)

(52) U.S. Cl. ..... 345/84; 345/85; 345/86; 345/109

(58) Field of Classification Search ..... 345/82, 345/76, 55, 42–46, 83, 204, 208, 212, 73.1, 345/1.1, 84–86, 109; 365/200; 315/169.3; 257/59; 324/770

See application file for complete search history.

(56) References Cited

U.S. PATENT DOCUMENTS 5,113,181 A * 5/1992 Inoue et al. ..... 345/84
5,731,803 A * 3/1998 Martin ..... 345/84
5,952,789 A * 9/1999 Stewart et al. ..... 315/169.4
6,498,592 B1 * 12/2002 Matthies ..... 345/1.1
6,504,524 B1 * 1/2003 Gates et al. ..... 345/107
6,762,735 B1 * 7/2004 Koyama ..... 345/76
6,777,712 B1 * 8/2004 Sanford et al. ..... 257/59
6,791,520 B1 * 9/2004 Choi ..... 345/89
6,809,710 B1 * 10/2004 Prache et al. ..... 345/82
6,897,855 B1 * 5/2005 Matthies et al. ..... 345/204
7,034,783 B1 * 4/2006 Gates et al. ..... 345/84
2001/0040565 A1 * 11/2001 Koyama ..... 345/204
2002/0033784 A1 * 3/2002 Machida et al. ..... 345/84
2003/0160746 A1 * 8/2003 Yamazaki et al. ..... 345/82
2003/0173991 A1 * 9/2003 Takafuji et al. ..... 324/770
2003/0179626 A1 * 9/2003 Sanford et al. ..... 365/200
2004/0095301 A1 * 5/2004 Shih ..... 345/84
2004/0201372 A1 * 10/2004 Tsai et al. ..... 324/73.1
2004/0239598 A1 * 12/2004 Koyama ..... 345/76
2005/0110064 A1 * 5/2005 Duan et al. ..... 257/296

* cited by examiner

*Primary Examiner*—Bipin Shalwala
*Assistant Examiner*—Prabodh Dharia
(74) *Attorney, Agent, or Firm*—Michael Bednarek; Pillsbury Winthrop Shaw Pittman LLP

(57) ABSTRACT

A method and a system for testing a plurality of driver circuits of an AMOLED before OLEDs are formed are provided. Each driver circuit includes a terminal, which is connected to an OLED after the OLED is formed, and is connected to a test element to form an electrical loop during the test. The system selects one specific driver circuit to test. The method and the system measure the value of a current signal flowing through the test element, and then analyze it to determine the status of the driver circuit. The said steps executed repeatedly, all driver circuits of the AMOLED are tested efficiently and precisely.

16 Claims, 7 Drawing Sheets

METHOD AND SYSTEM FOR TESTING DRIVER CIRCUITS OF AMOLED

This Application claims priority to Taiwan Patent Application No. 092107304 filed on Mar. 31, 2003.

FIELD OF THE INVENTION

The present invention provides a method and a system for testing driver circuits of an active matrix organic light emitting display (AMOLED) prior to formation of organic light emitting diodes (OLEDs).

BACKGROUND OF THE INVENTION

As technology progresses, the manufacturing technique of monitor display is also progressing. Following the technique of light emitting diodes (LEDs), the newest technique of monitor display brought to the market is one that utilizes organic light emitting diodes (OLEDs). Each OLED requires a driver circuit to drive it to emit light. The light can be of either a single color, such as red, green or blue, or even full colors. The advantages of OLEDs are the flexibility, liberation from vision angle restriction, thousands-hour product lifetime and low power consumption. Accordingly, OLEDs are very likely to replace LEDs and become the most popular monitor display in the next generation.

Each pixel of an AMOLED needs an OLED and a driver circuit, so there are ten thousands or even millions of driver circuits in one pad. It is then a complicated task to conclude the functionality of all driver circuits in one pad. FIG. 1, FIG. 2 and FIG. 3 show the common driver circuits configured to drive OLEDs of monitor displays. Referring now to FIG. 1, FIG. 2 and FIG. 3, the method of prior art for testing these driver circuits starts with enabling each one via the write scan line WSL and inputting a certain voltage level via the data line DL after OLEDs are formed. The driver circuit then transfers the voltage level into a current signal I which makes the OLED emit light. According to the voltage level, test engineers determine the OLED's functionality by subjectively observing its luminosity with eyes. If a driver circuit is concluded failed, the OLED having been formed in it is wasted and can not be recovered even though the OLED per se is good. Accordingly, this test method of prior art would result in not only imprecision caused by engineers' subjective decision but also high costs.

SUMMARY OF THE INVENTION

The present invention provides a method and a system to test the driver circuits of an AMOLED by utilizing a test element prior to formation of OLEDs. The AMOLED includes an input pad, a write scan line and a data line.

The method of the present invention includes the following steps: repeating the following steps until all driver circuits are tested, assigning a value of a data signal via the input pad, assigning a voltage value to the write scan line via the input pad to select a target driver circuit for test, measuring a current signal flowing through the test element, and analyzing the current signal to determine the functionality of the target driver circuit.

The system of the present invention includes a data input device, a pixel selection device and a measurement device. The data input device, connected to the input pad, is configured to input a data signal. The pixel selection device, connected to the input pad, is configured to input a selection signal to select a target driver circuit. The measurement device, connected to the input pad and a power supply, is configured to measure the current signal flowing through the test element to determine the functionality of the target driver circuit.

DETAILED DESCRIPTION

Figure 1:
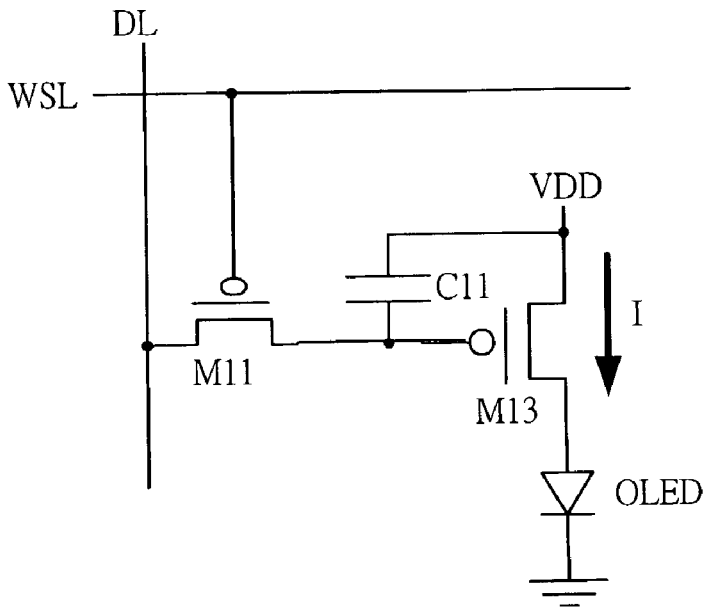
Fig. 1 (prior art)
FIG. 1 illustrates one driver circuitry to be tested by the method of the prior art.
Figure 2:
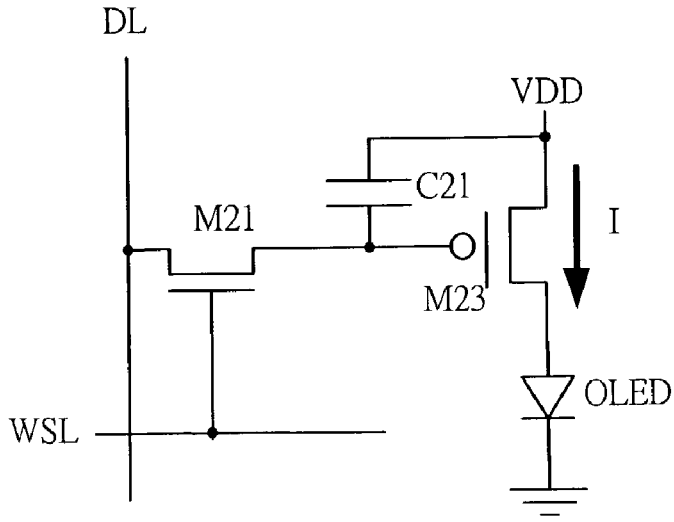
Fig. 2 (prior art)
FIG. 2 illustrates another driver circuitry to be tested by the method of the prior art.
Figure 3:
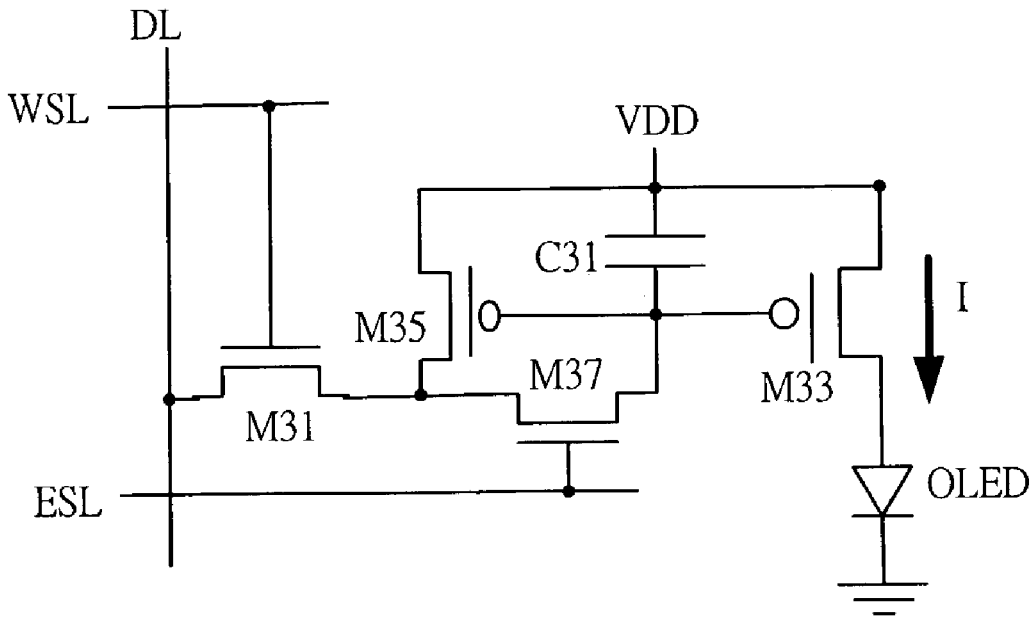
Fig. 3 (prior art)
FIG. 3 illustrates still another driver circuitry to be tested by the method of the prior art.
Figure 4:
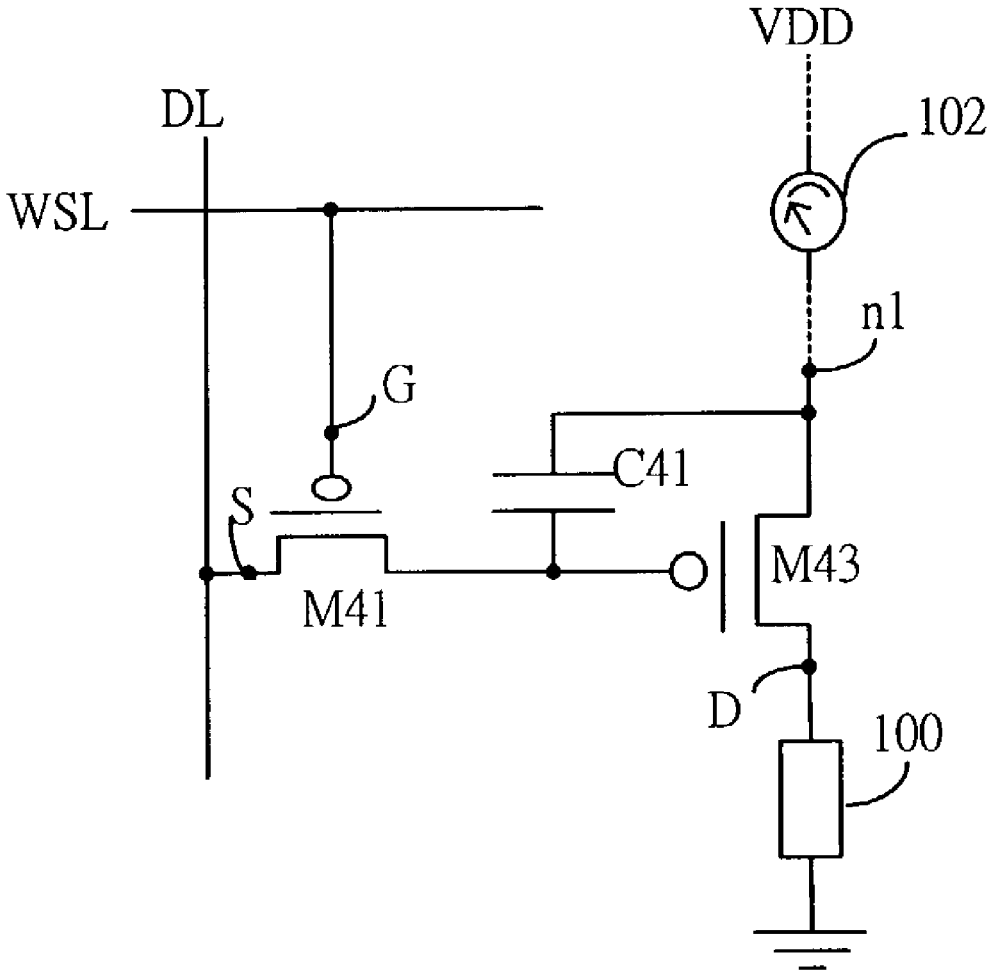
FIG. 4 illustrates the first circuitry to be tested by the method of the present invention.

The present invention provides a method for testing the driver circuits of an AMOLED prior to formation of OLEDs. The AMOLED has a plurality of driver circuits used to drive a plurality of OLEDs. The AMOLED further includes an input pad, a write scan line and a data line. The input pad is configured to input a selection signal for selecting a target driver circuit and to input a data signal to make the OLED luminous after the OLED has been formed into the target driver circuit. The write scan line which receives the selection signal from the input pad is configured to enable or disable the target driver circuit. The data line which receives the data signal from the input pad is configured to transmit the data signal to the target driver circuit. FIG. 4 shows one of the common driver circuits, before formation of an OLED, to be tested by the method of the present invention. With reference to FIG. 4, a driver circuit includes a first transistor M41, a second transistor M43 and a test element 100. The first transistor M41 and the second transistor M43 respectively include a source S, a gate G and a drain D. The source S, or the drain, of the first transistor M41 is connected to the data line DL of the AMOLED. The gate G of the first transistor M41 is connected to the write scan line WSL of the AMOLED. The drain D, or the source, of the second transistor M43 will be connected to an OLED after the OLED is formed. To perform the testing method of the present invention, the test element 100 has to be connected to the drain D of the second transistor M43 prior to formation of the OLED in order to form an electrical loop for test (power supply VDD→ the second transistor M43→ the test element 100→ ground).

Figure 5:
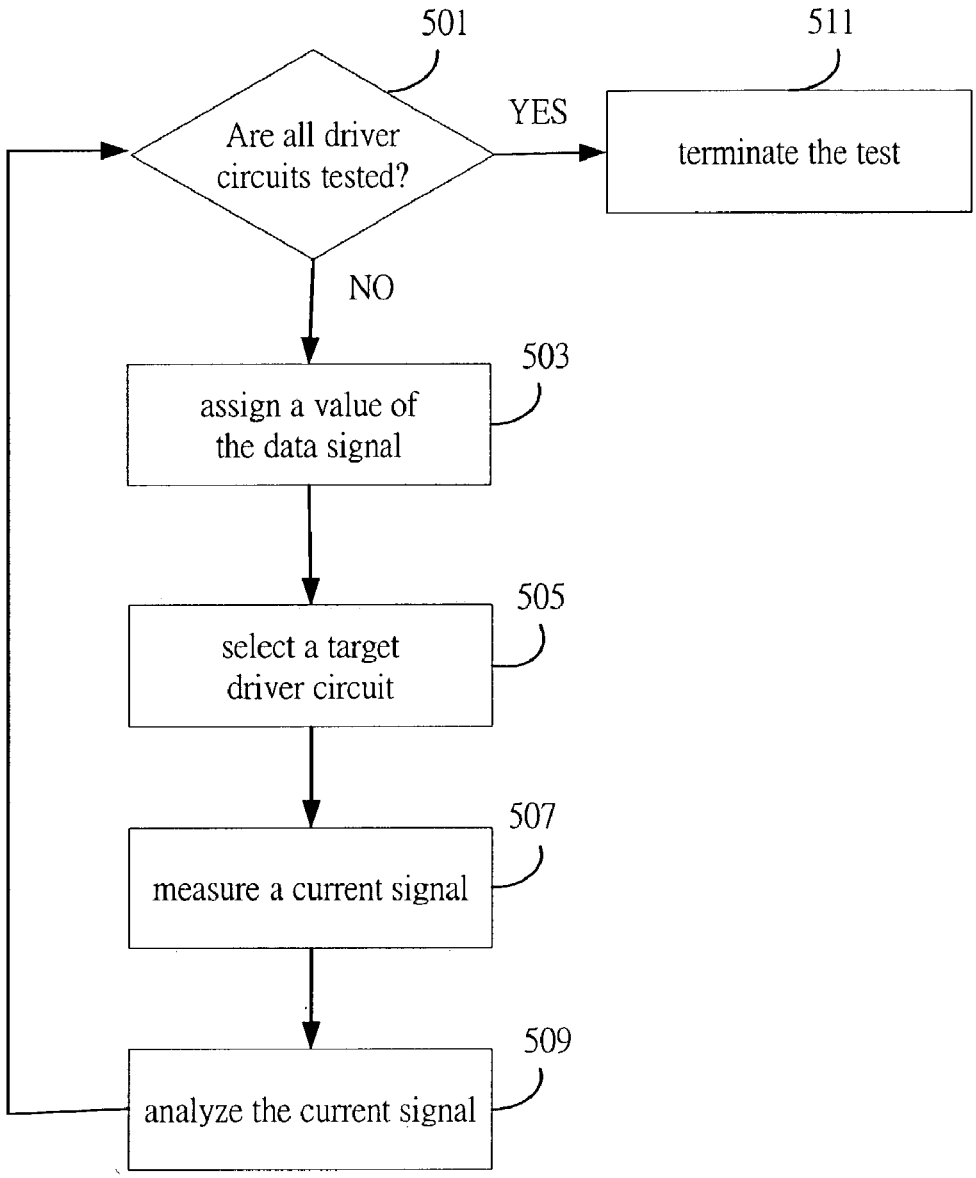
FIG. 5 illustrates the flow chart of the method provided by the present invention.

FIG. 5 shows the steps of the method provided by the present invention. With reference to FIG. 4 and FIG. 5, the method of the present invention is described as below. In step 501, whether all driver circuits of the AMOLED have been tested is being checked. If the result is negative, step 503 is executed, in which a value of the data signal is assigned to the data line DL via the input pad. In step 505, a voltage level is assigned to the write scan line WSL via the input pad in order to select a target driver circuit to test. For example, because the first transistor M41 of the driver circuit in FIG. 4 is a p-channel TFT, in step 505, a low voltage level is transmitted through the write scan line WSL to the gate G of the first transistor M41 so as to turn on the first transistor M41. Once the first transistor M41 is turned on, the data signal assigned in step 503 can enter the target driver circuit. In step 507, a current signal flowing through the test element 100 is measured. To measure the current signal, a measurement device 102 and the test element 100 are required to be a series connection. However, the connection between the drain D of the second transistor M43 and the test element 100 and the connection between the test element 100 and ground are already fixed, so the measurement device 102 is preferred to be disposed between the power supply VDD and a node n1. In step 509, the current signal is analyzed to determine the functionality of the target driver circuit. If the functionality of the target driver circuit is normal, step 501 is executed again to check whether all driver circuits of the AMOLED have been tested. If still not, steps 503, 505, 507 and 509 are repeated. If yes, step 511 is executed to finish the whole test process. If the functionality of the target driver circuit is abnormal, its position is recorded and then step 501 is executed again.

The test element 100 is formed to generate an electrical loop to facilitate the measurement of the current signal flowing through the test element 100. A resistor is suitable to be used as the test element 100. To avoid influencing the function of the OLED, the value of the resistor must be highly larger than the resistivity of an active OLED. It is suggested that the value of the resistor is at least 100 times larger than the resistivity of an active OLED. Since the resistivity of an active OLED is about 10Ω~10KΩ, the value of the resistor as the test element 100 is about 1KΩ~100MΩ. In addition to resistors, TFTs or other electrical components can be used as the test element 100 as long as the above resistivity requirement is met.

Taking the driver circuit in FIG. 4 as an example, if the initial settings of the power supply VDD and the write scan line WSL are respectively 12V and 0V, the first transistor M41 is turned on and the driver circuit is enabled, so that the data signal is able to enter the driver circuit. The data signal is a voltage value within a range from 7V to 10V. This range is divided into 64 gray scales in order to drive OLEDs to emit light at 64 different luminous levels. If a driver circuit can operate normally, the expected range of the measured current signal should be from 20 μA to 0.002 μA. Also, the range between 20 μA and 0.002 μA, corresponding to the range of the data signal, can be divided into 64 gray scales. In step 503, the data signal is selected from any of the 64 gray scales within the range from 7V to 10V. If the target driver circuit can operate normally, then the level of the current signal measured in step 509 should fall in the corresponding gray scale.

The data signal can be a current signal with a value ranging from 20 μA to 0.002 μA. Similarly, this range is divided into 64 gray scales in order to drive OLEDs to emit light at 64 different luminous levels. If the target driver circuit can operate normally, then the level of the current signal measured in step 509 should fall in the range between 20 μA and 0.002 μA as well.

Using the method of the present invention, testing the driver circuits of an AMOLED can be accomplished precisely and efficiently, avoiding diverse test results caused by test engineers' subjective decisions.

Figure 6:
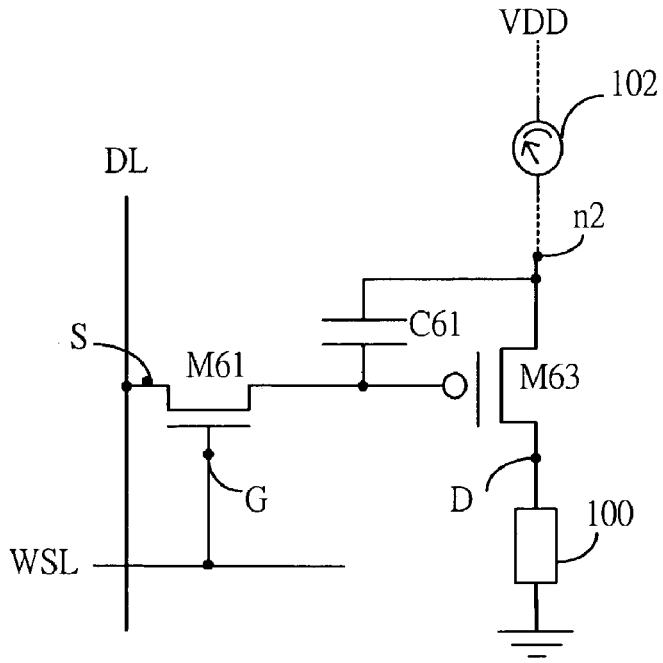
FIG. 6 illustrates the second circuitry to be tested by the method of the present invention.
Figure 7:
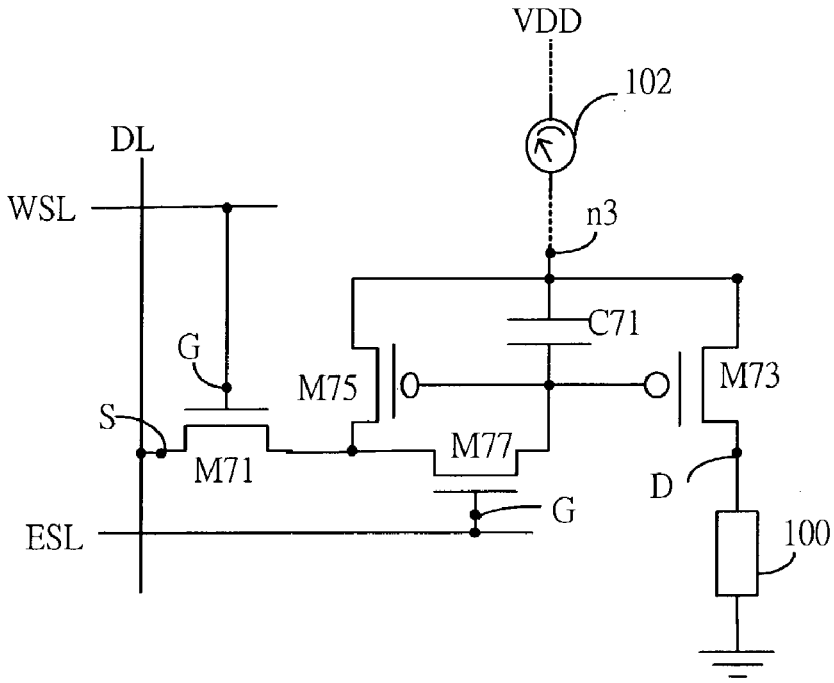
FIG. 7 illustrates the third circuitry to be tested by the method of the present invention.

The driver circuits shown in FIG. 6 and FIG. 7 are also well known. The difference between those and the driver circuit shown in FIG. 4 is the types of the first transistors. More specifically, the first transistors M61 and M71 in FIG. 6 and FIG. 7 are n-channel TFTs, while the first transistor M41 in FIG. 4 is a p-channel TFT. Accordingly, the data signal in the write scan line WSL to enable the driver circuits shown in FIG. 6 and FIG. 7 should be assigned a high voltage level. Besides, the AMOLED with the driver circuits of FIG. 7 further includes an erase scan line ESL configured to eliminate the potential already stored in the capacitor C71 before the data signal enters.

Figure 8:
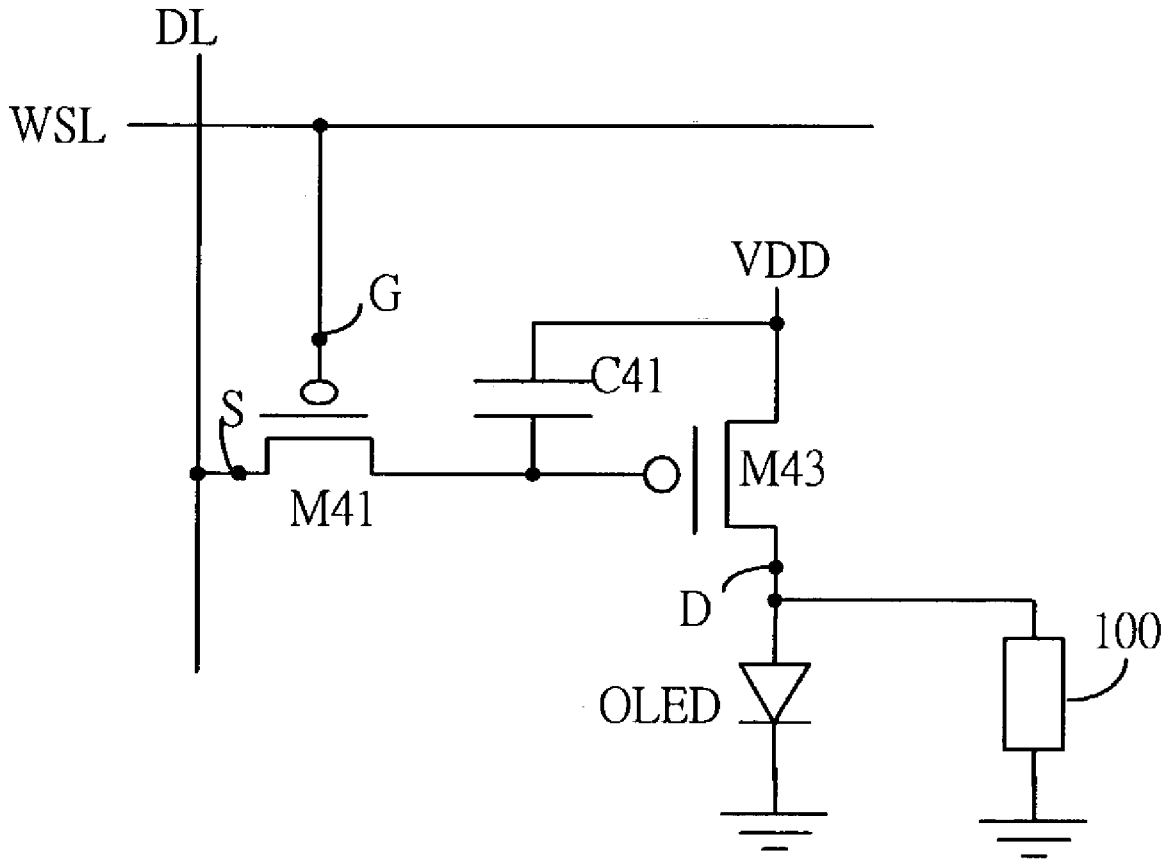
FIG. 8 illustrates the driver circuitry after the formation of an OLED.

When the test process in FIG. 5 is finished, the measurement device 102 will be removed and OLEDs will be formed into the driver circuits determined to be normal. FIG. 8 illustrates the driver circuit shown in FIG. 4 with an OLED in it. Although the test element 100 might not be removed after the test process or be connected to the OLED in parallel, the current flowing through the test element 100 can be ignored because of the huge difference in resistivity of the test element 100 and the OLED. Accordingly, a current flowing through the OLED still can make it function normally.

The method of the present invention can effectively test not only the driver circuits shown in FIG. 4, FIG. 6, and FIG. 7 but also other similar driver circuits not mentioned herein.

Figure 9:
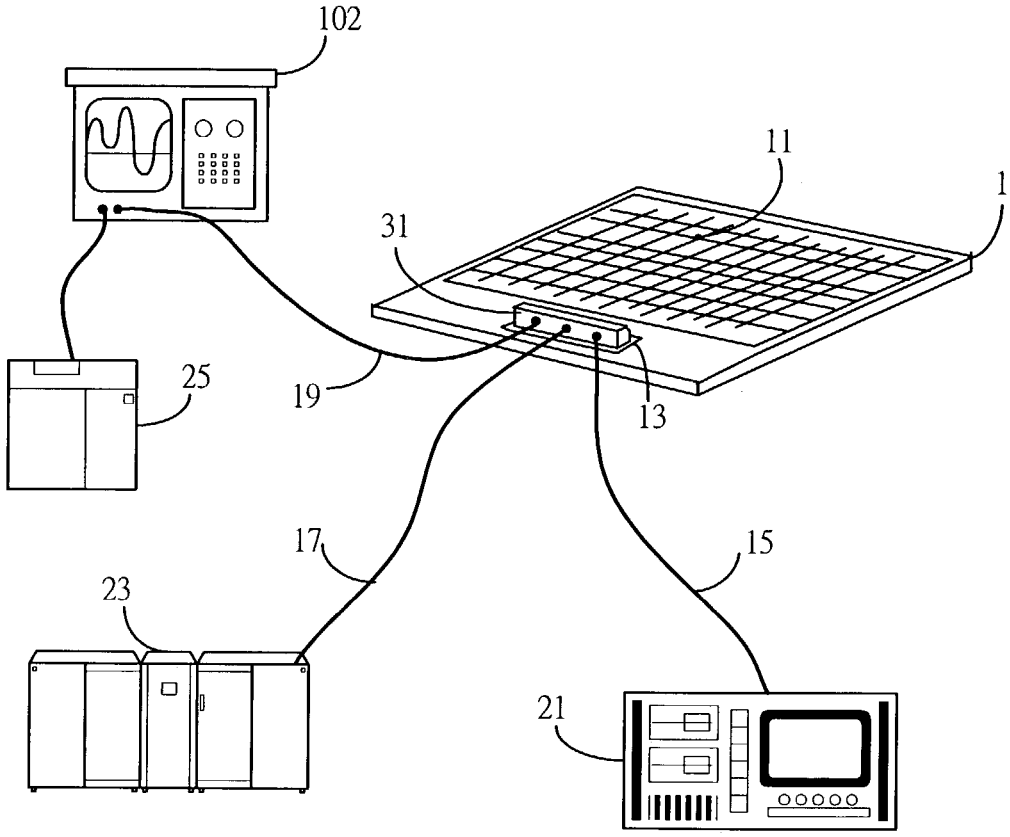
FIG. 9 illustrates the exemplary embodiment of the system provided by the present invention.

The present invention also discloses a system configured to execute the above test method. As FIG. 9 shows, the system includes a data input device 21, a pixel selection device 23 and a measurement device 102. The data input device 21 for inputting the data signal 15 is connected to an input pad 13 via a connector 31. The pixel selection device 23 for inputting the selection signal 17 to select a target driver circuit 11 is also connected to the input pad 13 via the connector 31. The measurement device 102 for measuring the current signal 19 to determine the functionality of the target driver circuit 11 is connected to a power supply 25 and, via the connector 31, to the input pad 13. If the functionality of the target driver circuit 11 is not normal, the measurement device 102 records a position of the target driver circuit 11.

The above description of the preferred embodiments is expected to clearly expound the characteristics of the present invention but not expected to restrict the scope of the present invention. Those skilled in the art will readily observe that numerous modifications and alterations of the apparatus may be made while retaining the teaching of the invention. Accordingly, the above disclosure should be construed as limited only by the bounds of the claims.

The invention claimed is:

1. A method for testing a plurality of driver circuits of an active matrix organic light emitting display (AMOLED) before organic light emitting diodes are formed, each of the plurality of driver circuits comprising a test element, the display comprising:

an input pad for inputting a selection signal and a data signal;

a write scan line for enabling a target driver circuit to be tested in response to the selection signal; and a data line for transmitting the data signal to the target driver circuit; the method comprising the steps of:

(a) determining whether all of the plurality of driver circuits are tested, and if not all of the plurality of driver circuits are tested, executing the step (b)–(e), if all of the plurality of driver circuits are tested, terminating the test;

(b) assigning a value of the data signal via the input pad;

(c) assigning a value of the selection signal via the input pad;

(d) measuring a current signal flowing through the test element; and (e) analyzing the current signal to determine whether the functionality of the target driver circuit is normal, and if the functionality of the target driver circuit is normal, selecting another driver circuit to be tested and returning to the step (a), if functionality of the target driver circuit is not normal, recording a position of the target driver circuit, selecting another driver circuit to be tested and returning to step (a).

2. The method of claim 1, wherein the test element is a resistor.

3. The method of claim 2, wherein value of resistor is from 1kΩ to 100MΩ.

4. The method of claim 1, wherein the test element is a thin film transistor (TFT).

5. The method of claim 1, wherein the data signal is a voltage signal and value of the data signal is from 7V to 10V.

6. The method of claim 1, wherein the data signal is a current signal and value of the data signal is from 20 μA to 0.002 μA.

7. The method of claim 5, wherein in the step (e), the target driver circuit is determined to be normal if value of the current signal flowing through the test element is from 20 μA to 0.002 μA.

8. The method of claim 6, wherein in the step (e), the target driver circuit is determined to be normal if value of the current signal flowing through the test element is from 20 μA to 0.002 μA.

9. A system for testing a plurality of driver circuits of an active matrix organic light emitting display (AMOLED) before organic light emitting diodes are formed, each of the plurality of driver circuits comprising a test element, the display comprising:

an input pad for inputting a selection signal and a data signal;

a write scan line for enabling a target driver circuit to be tested in response to the selection signal; and a data line for transmitting the data signal to the target driver circuit;

the style comprising:

an input pad for inputting a selection signal and a data signal;

a write scan line for enabling a target driver circuit to be tested in response to the selection signal; and a data line for transmitting the data signal to the target driver circuit; the system comprising:

a data input device, connected to the input pad, for assigning a value of the data signal; a pixel selection device, connected to the input pad, for assigning a value of the selection signal;

a measurement device, connected to the input pad, for measuring a current signal flowing through the test element, wherein the measurement device determines whether the functionality of the target driver circuit is normal, and records a position of the target driver circuit if functionality of the target driver circuit is not normal.

10. The system of claim 9, wherein the test element is a resistor.

11. The system of claim 10, wherein value of the resistor is from 1kΩ to 100MΩ.

12. The system of claim 9, wherein the test element is a thin film transistor (TFT).

13. The system of claim 9, wherein the data input device generates a voltage signal with value from 7V to 10V.

14. The system of claim 9, wherein the data input device generates a current signal with value from 20μA to 0.002 μA.

15. The system of claim 13, wherein the target driver circuit is determined to be normal if value of the current signal flowing through the test element is from 20 μA to 0.002 μA.

16. The system of claim 14, wherein the target driver circuit is determined to be normal if value of the current signal flowing through the test element is from 20 μA to 0.002 μA.

* * * * *